US007262351B2

(12) United States Patent
Inouye

(10) Patent No.: US 7,262,351 B2
(45) Date of Patent: Aug. 28, 2007

(54) PIANO HAMMER

(76) Inventor: Asami Inouye, 180 riverside Blvd. #511, New York, NY (US) 10069

( * ) Notice: Subject to any disclaimer, the term of this patent is extended or adjusted under 35 U.S.C. 154(b) by 270 days.

(21) Appl. No.: 11/113,204

(22) Filed: Apr. 22, 2005

(65) Prior Publication Data

US 2005/0235803 A1 Oct. 27, 2005

(51) Int. Cl.
*G10C 3/18* (2006.01)

(52) U.S. Cl. ..... 84/254; 84/236

(58) Field of Classification Search ..... 84/236, 84/254

See application file for complete search history.

(56) References Cited

U.S. PATENT DOCUMENTS

| | | | | | |
|---|---|---|---|---|---|
| 138,001 | A | * | 4/1873 | Bullard | 84/254 |
| 231,629 | A | * | 8/1880 | Steinway | 84/254 |
| 317,651 | A | * | 5/1885 | Junger | 84/254 |
| 465,505 | A | * | 12/1891 | Weser | 84/460 |
| 731,535 | A | * | 6/1903 | Bell | 84/460 |
| 738,877 | A | * | 9/1903 | Behringer | 84/460 |
| 934,654 | A | * | 9/1909 | Bode | 84/254 |
| 959,190 | A | * | 5/1910 | Young | 84/254 |
| 1,104,691 | A | * | 7/1914 | Miller | 84/254 |
| 1,454,727 | A | * | 5/1923 | Crissey | 84/460 |
| 1,672,297 | A | * | 6/1928 | Bode | 84/254 |
| 1,785,165 | A | * | 12/1930 | Woods | 84/460 |
| 1,892,416 | A | * | 12/1932 | Vitto | 84/422.4 |
| 2,807,295 | A | * | 9/1957 | Tucker et al. | 144/29 |
| 3,487,429 | A | * | 12/1969 | Johnson | 84/254 |
| 3,577,519 | A | * | 5/1971 | Gambardella et al. | 264/54 |
| 3,878,752 | A | * | 4/1975 | Yamada | 84/254 |
| 4,135,430 | A | | 1/1979 | Hayashida | |
| 4,632,006 | A | * | 12/1986 | Ambroszewski | 84/422.4 |
| 5,125,310 | A | * | 6/1992 | Lombino | 84/254 |
| 5,311,805 | A | * | 5/1994 | Muller | 84/460 |
| 5,932,821 | A | * | 8/1999 | Kitajima et al. | 84/254 |
| 7,217,877 | B2 | * | 5/2007 | Funaki | 84/433 |
| 2005/0235803 | A1 | * | 10/2005 | Inouye | 84/236 |
| 2006/0070515 | A1 | * | 4/2006 | Funaki et al. | 84/745 |

OTHER PUBLICATIONS

Van Nattan, Steve, "Piano Owner's Guide," copyright 1996, html version 2001, http:/www.balaams-ass.com/piano/piancont.htm and subpage /27-hmbk3.htm.*

About Pellon Consumer Products, History of Pellon, http://www.pellonideas.com/content/view/12/26/.*

* cited by examiner

*Primary Examiner*—Lincoln Donovan
*Assistant Examiner*—Robert W. Horn
(74) *Attorney, Agent, or Firm*—Milde & Hoffberg, LLP

(57) ABSTRACT

A piano hammer comprises an elongate hammer head having a nose portion defining side surfaces and a felt covering extending about the nose portion with tail portions of the felt covering affixed to the side surfaces. The felt covering defines a substantially elliptical peripheral surface from a top region for striking a piano string to front and back regions. An elongate strip is arranged on the peripheral surface of the felt covering in the top region, extending along the front and back regions to points beyond the hammer equator. This strip or "voicing tape" is made of a synthetic non-woven fabric material, preferably of the type sold under the registered trademark Pellon.

12 Claims, 1 Drawing Sheet

PIANO HAMMER

BACKGROUND OF THE INVENTION

The present invention relates to a piano hammer of the type used in the mechanical action of any type of piano, be it a grand piano ("pianoforte") or an upright piano. More particularly, the invention relates to a covering on the striking surface of a piano hammer which results in improved tone quality, increased dynamic range and improved durability of the hammer.

One of the critical operating components of the mechanical action in a piano is the hammer that strikes the wire or wires of the piano string. Since the tone quality of each note in a piano is dependent upon the construction and density of the hammer, many attempts have been made to improve the hammer and especially its contact surface.

A piano hammer conventionally comprises an elongate "hammer head", usually made of wood, having a nose portion that is usually wedge shaped. A felt covering surrounds the nose portion with tail portions affixed to the side surfaces of the nose portion, usually with glue and a reinforcing staple. Such felt covering defines a substantially elliptical peripheral surface which extends from the top of the hammer, in the region which strikes the piano string, away from this region through a widest point between the front and back of the hammer, hereinafter called the "equator" of the hammer, to the terminus of the tail portions. (It will be understood that the "top", "front" and "back" of the hammer refer to the respective sides of a hammer as installed in a grand piano. This terminology will be used herein although the hammer may be installed in an upright piano where the "top" becomes the "front" of the hammer and the "front" and "back" become the "bottom" and "top", respectively). Over time, the felt covering generally becomes worn and/or compressed and hardened at the top region under continuous use to such an extent as to impair the tone of the piano. Attempts have therefore been made to find a felt covering material which is highly resistant to wear and other damage.

The U.S. Pat. No. 3,487,429 to Johnson discloses a piano hammer having the felt covering forming the striking member comprised of a blend of wool fibers and thermoplastic fibers. This felt covering is said to be durable and can be formed with a "controlled density" for different registers of the piano.

The U.S. Pat. No. 4,135,430 to Hayashida discloses a simplified piano hammer comprising a wooden base, a striking head and an outer "protective covering" surrounding the end of the wooden base and covering the striking head. The striking head is a relatively thin strip made of elastic material such as polyurethane. The protective covering is made of a "protective material such as deer-skin or artificial leather".

The U.S. Pat. No. 5,125,310 to Lombino teaches a piano hammer comprising an elongate wooden head with a "nose portion" and a felt body extending about the nose portion. Tail portions of the felt body are affixed to the side surfaces of the nose portion. The felt body is comprised of an "outer felt" made of 100% wool and an "under felt". The patent is directed to a method of manufacturing wherein the sides of the outer felt are impregnated with an aqueous solution containing an acrylic copolymer.

SUMMARY OF THE INVENTION

A principal object of the present invention is to provide an improved piano hammer which is more durable and long lasting than piano hammers of the prior art while at the same time yielding improved tone quality and dynamic range of the piano.

This object, as well as other objects which will become apparent from the discussion that follows, are achieved, in accordance with the present invention, by providing a conventional, felt-covered piano hammer with an elongate strip of material arranged on the peripheral surface of the felt covering, at least in the region thereof which strikes the piano string. This strip, which is sometimes referred to below as a "voicing tape", is made of a synthetic non-woven fabric material, preferably of the type sold under the registered trademark "Pellon".

"Pellon" is the registered trademark for a material produced and sold by Freudenberg Nonwovens, LP, of Durham, N.C. It is formed of fine thermoplastic threads which are made into a non-woven cloth.

Preferably, the elongate strip extends from the top of the hammer, in the region for striking the piano string, downward and away from this region to the widest point, between the front and back of the hammer, herein called the "equator" of the hammer. The strip is attached to the felt covering by means of an adhesive disposed in an area near each end of the strip. This adhesive area extends from the end of the strip for a distance toward the center of the strip which is approximately equal to the width of the strip.

When applied to the felt covering, the adhesive area of the elongate strip is disposed between the equator of the hammer and the bottom terminus of the covering, at the point where the wooden nose portion remains exposed. In the case of hammers (e.g., for the bass and mid-range registers of a piano) that have a staple holding the felt covering in place, the elongate strip preferably extends a short distance beyond the staple, to cover the staple.

Preferably, the width of the elongate strip is substantially equal to the width of the felt covering.

When positioned and attached in the manner described above, the elongate strip will be approximately four inches long for a hammer in the bass register of a piano, tapering to approximately two inches for a hammer in the treble register.

Pellon material is available on the market in lightweight, medium and heavyweight thickness, and in hard and soft textures. Preferably, a medium lightweight thickness, or a medium weight thickness, is used such that the thickness of the elongate strip will be in the range of 0.015 inches to 0.025 inches when uncompressed, and in the range of 0.004 inches to 0.007 inches when compressed. Preferably also, a soft and/or smooth texture is used.

The elongate strip or voicing tape is preferably attached to the felt cover of the hammer by means of a white adhesive, such as Elmer's white glue.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
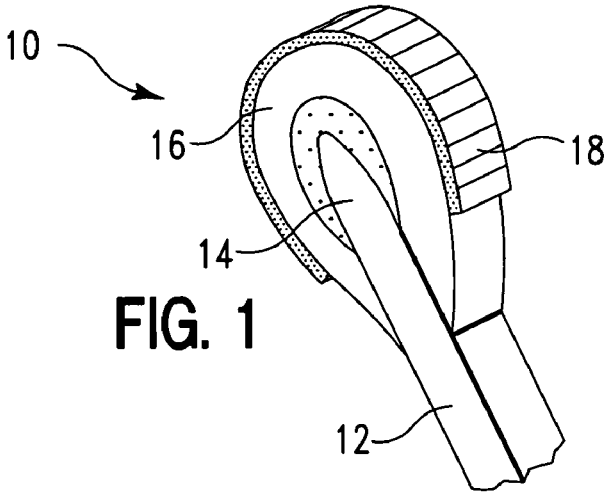
FIG. 1 is a perspective view of a piano hammer upon which is applied a voicing tape according to the present invention.

The preferred embodiments of the present invention will now be described with reference to FIGS. 1-4 of the drawings. Identical elements in these two figures are designated with the same reference numerals.

FIG. 1 shows a conventional piano hammer 10 comprising an elongate, wooden hammer head 12 having a nose portion 14 and a felt covering 16 affixed to the nose portion by means of an adhesive and a staple. The felt covering defines a substantially elliptical peripheral surface. As is well known, the top surface region of the felt covering of the piano hammer strikes the piano string (the piano wire or wires) and thus creates the musical tone.

According to the invention, an elongate strip or "voicing tape" 18 is arranged on the peripheral surface of the felt covering, at least in the region thereof which strikes the piano string. This strip is made of a synthetic non-woven material, preferably medium lightweight or medium weight Pellon, with a soft and smooth texture.

As may be seen in FIG. 1, the voicing tape is substantially equal in width to the width of the felt covering of the hammer.

The voicing tape 18 is affixed to the felt covering by means of an adhesive, preferably a white adhesive such as Elmer's white glue. Such glue is strong enough to hold the voicing tape, but allows the tape to be removed and replaced at a later date. As will be explained below, the area in which the adhesive is applied is restricted to the end regions of the tape. No glue is applied between the tape and the felt covering of the hammer in the region near the top of the hammer which strikes the piano string. In this way, only the felt covering and the voicing tape are involved in striking the string, so that the adhesive will not effect the tone of the piano.

Figure 2:
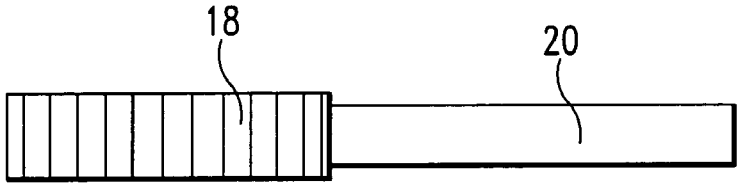
FIG. 2 is a top view of a piano hammer with a voicing tape according to the present invention.
Figure 3:
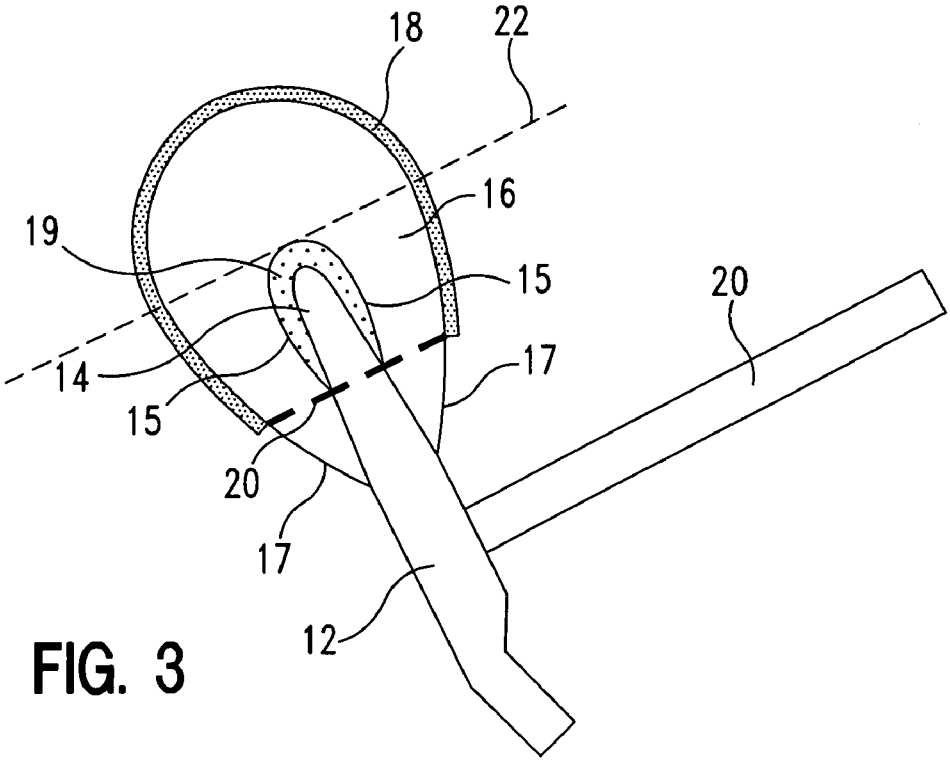
FIG. 3 is a side view of a piano hammer according to the preferred embodiment of the present invention.

FIGS. 2 and 3 illustrate the hammer head of FIG. 1 in top view and side view, respectively. As best seen in FIG. 3, the nose portion 14 of the hammer head 12, which is normally made of wood, has side surfaces 15. Tail portions 17 of the felt covering 16 are affixed to these side surfaces with an adhesive and, in most cases, by means of a staple 20. As shown by a dashed line in FIG. 3, this staple passes through the interior of the felt covering and the nose portion. Preferably, the region 19 of the felt covering immediately adjacent the nose portion 14 with its side surfaces 15 is impregnated with a hardening material such as an acrylic to improve its adhesion to the hammer 12. The wooden hammer head 12 is carried, in the mechanical action of the piano, by a wooden shank 20.

In the preferred embodiment, shown in FIG. 3, the elongate strip or voicing tape 18 extends around the peripheral surface of the felt covering, from the front surface of the hammer to the back, covering the top region which strikes the piano string. It is preferable that the tape 18 extend beyond a line 22, at the "equator" of the hammer, which passes through the hammer at its widest point. It is also preferable that the adhesive between the tape and the felt covering be restricted to the area of the tape that extends "below" the equator, away from the region of the hammer that strikes the string, so that the adhesive will have no effect on the piano tone quality.

For hammers in the bass register of a piano, the voicing tape 18 preferably extends downward slightly beyond the staple 20, thus covering the staple. In the mid range of the piano, the voicing tape may reach lower and lower on the hammers as they progress upward toward the treble. In the treble region the voicing tape may completely cover the periphery of the felt covering on the hammers.

Figure 4:
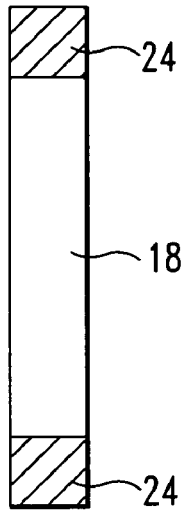
FIG. 4 is a plan view of a voicing tape according to the present invention.

FIG. 4 shows a voicing tape 18 in plan view. The areas 24 on which the adhesive is applied extend from each end of the tape for a distance toward the center of the tape which is approximately equal to the width of the tape.

Prior to applying a voicing tape to a hammer, the top region of the felt covering which strikes the piano string is sanded or filed, as necessary, and ironed to remove any grooves or the like which were made during previous use of the hammer. Thereafter, adhesive is applied to the voicing tape 18 to the areas 24 in FIG. 4 and the tape is wound tightly around the peripheral surface of the felt covering 16 of the hammer. It is held down with a short strip of cellophane tape, such as Scotch tape, at each end until the adhesive, preferably Elmer's white glue, has fully cured. If the acoustics of the piano require more muting, depending on the location of the piano and/or the musical taste of its owner, it is possible to add a second layer of voicing tape on top of the first. This is found to be preferable to using tape with a greater thickness.

The application of voicing tapes to the piano hammers can be done at any time during the life of a piano, whether the piano is new or old. As noted above, the region of the piano hammer which strikes the piano string should be filed smooth, to eliminate any grooves, in the case of an older piano.

Depending upon the size and shape of the hammers, the length of the elongate strip or voicing tape 18 is preferably in the range of approximately 9 to 10 cm (4 inches) for the No. 1 hammer, tapering to approximately 5 to 6 cm (2 inches) for the No. 88 hammer, with the lengths in between decreasing from hammer to hammer. The thickness of the elongate strip is preferably in the range of 0.015 inches to 0.025 inches when uncompressed or 0.004 inches to 0.007 inches when compressed.

It has been found that application of the elongate strip or "voicing tape" to a piano hammer makes the piano much quieter, with a −10 to −30 dB reduction in volume, while increasing the dynamic range from pppp to ffff, making the piano more responsive and sensitive to the touch of the player. While the voicing tapes may be applied to any piano, the resultant muting may not always be desirable for a grand piano (pianoforte) in a large concert hall.

In addition, application of the voicing tape to each of the hammers of a piano results immediately in an evenness of tone, eliminating the constant need for voicing. In effect, the tape provides a "permanent voicing" for the piano.

Furthermore, the voicing tapes improve the tone quality of the piano, without need for replacing old or poor quality strings or hammers, and preserve the piano hammers for an extended period of time. The voicing tapes also make the sound of the piano more "pleasant", in spite of imperfections in the piano.

There has thus been shown and described a novel piano hammer which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a piano hammer comprising an elongate hammer head having a nose portion defining side surfaces and a felt covering surrounding the nose portion with tail portions of the felt covering affixed to the side surfaces, said felt covering defining a substantially elliptical peripheral surface which extends from a top of the hammer, in a region for striking a piano string, away from this region through a widest point, between a front and a back of the hammer, called an "equator", to the terminus of said tail portions, the improvement comprising an elongate voicing tape arranged on the peripheral surface of the felt covering and extending from said region for striking a piano string along both sides of the hammer to points on the front and back thereof beyond said equator, said voicing tape being made of a synthetic, non-woven fabric material, wherein said voicing tape is resistant to wear and other damage and permanently re-voices the piano, when applied to all keys, making the piano quieter and extending its dynamic range.

2. The piano hammer defined in claim 1, wherein the width of said voicing tape is substantially equal to the width of said felt covering.

3. The piano hammer defined in claim 1, wherein said synthetic, non-woven fabric material has a soft and smooth texture.

4. The piano hammer defined in claim 1, wherein said felt covering is retained on said nose portion, at least in part, by means of a staple affixing said tail portions to said nose portion, and wherein said voicing tape extends on each side of said hammer to a point near said staple.

5. The piano hammer defined in claim 4, wherein said voicing tape covers said staple on both the front and back of said hammer.

6. The piano hammer defined in claim 1, wherein the length of said voicing tape is approximately 4 inches on a hammer in a bass register of a piano, tapering to approximately 2 inches on a hammer in a treble register.

7. The piano hammer defined in claim 1, wherein said voicing tape has a thickness in the range of 0.015 inches to 0.025 inches when uncompressed and in the range of 0.004 inches to 0.007 inches when compressed.

8. The piano hammer defined in claim 1, wherein said voicing tape is attached to said felt covering by means of an adhesive disposed in an area adjacent each end of said strip.

9. The piano hammer defined in claim 8, wherein said adhesive area extends from each end of said voicing tape a distance toward the center of said tape which is approximately equal to the width of said tape.

10. The piano hammer defined in claim 8, wherein said adhesive is white glue.

11. The piano hammer defined in claim 10, wherein said adhesive is Elmer's white glue.

12. The piano hammer defined in claim 1, wherein said synthetic, non-woven fabric material is a material sold under the registered trademark Pellon.

* * * * *